US011225698B2

(12) United States Patent
Takajo et al.

(10) Patent No.: US 11,225,698 B2
(45) Date of Patent: Jan. 18, 2022

(54) GRAIN-ORIENTED ELECTRICAL STEEL SHEET AND PROCESS FOR PRODUCING SAME

(71) Applicant: JFE STEEL CORPORATION, Tokyo (JP)

(72) Inventors: Shigehiro Takajo, Tokyo (JP); Hiroaki Toda, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 799 days.

(21) Appl. No.: 15/519,653

(22) PCT Filed: Oct. 23, 2014

(86) PCT No.: PCT/JP2014/005395
§ 371 (c)(1),
(2) Date: Apr. 17, 2017

(87) PCT Pub. No.: WO2016/063317
PCT Pub. Date: Apr. 28, 2016

(65) Prior Publication Data

US 2017/0253940 A1 Sep. 7, 2017

(51) Int. Cl.
*C21D 8/12* (2006.01)
*H01F 1/16* (2006.01)
(Continued)

(52) U.S. Cl.
CPC ..... *C21D 8/12* (2013.01); *C21D 1/34* (2013.01); *C21D 6/00* (2013.01); *C22C 38/00* (2013.01); *C23C 30/00* (2013.01); *H01F 1/16* (2013.01)

(58) Field of Classification Search
CPC ... C21D 8/12; C21D 1/34; C21D 6/00; C21D 8/1277; C22C 38/00; C23C 30/00; H01F 1/16
See application file for complete search history.

(56) References Cited

U.S. PATENT DOCUMENTS 5,665,455 A 9/1997 Sato et al.
9,330,839 B2 5/2016 Omura et al.
(Continued)

FOREIGN PATENT DOCUMENTS

CN 102031342 A 4/2011
CN 103025903 A 4/2013
(Continued)

OTHER PUBLICATIONS

Apr. 11, 2018, Office Action issued by the Canadian Intellectual Property Office in the corresponding Canadian Patent Application No. 2964849.
(Continued)

*Primary Examiner* — Jonathan C Langman
(74) *Attorney, Agent, or Firm* — Kenja IP Law PC

(57) ABSTRACT

Disclosed is a grain-oriented electrical steel sheet that exhibits excellent iron loss properties and a good building factor, in which damage to a tension coating is suppressed. In a grain-oriented electrical steel sheet having a tension coating, an interlaminar current is 0.15 A or less, a plurality of linear strain regions extending in a direction transverse to the rolling direction are formed, the strain regions are formed at line intervals in the rolling direction of 15 mm or less, each of the strain regions has closure domains formed therein, and each of the closure domains has a length d along the sheet thickness direction of 65 μm or more and a length w along the rolling direction of 250 μm or less.

9 Claims, 6 Drawing Sheets

(51) Int. Cl.

| | |
|---|---|
| ***C21D 1/34*** | (2006.01) |
| ***C21D 6/00*** | (2006.01) |
| ***C22C 38/00*** | (2006.01) |
| ***C23C 30/00*** | (2006.01) |

(56) References Cited

U.S. PATENT DOCUMENTS

| | | | | |
|---|---|---|---|---|
| 10,062,483 | B2 | 8/2018 | Inoue et al. | |
| 2009/0145526 | A1* | 6/2009 | Arai | H01F 1/16 148/512 |
| 2013/0098507 | A1 | 4/2013 | Omura et al. | |
| 2013/0206283 | A1 | 8/2013 | Inoue et al. | |
| 2014/0234638 | A1 | 8/2014 | Takajo et al. | |
| 2014/0338792 | A1 | 11/2014 | Takajo et al. | |
| 2014/0360629 | A1 | 12/2014 | Inoue et al. | |
| 2015/0310973 | A1 | 10/2015 | Takajo et al. | |
| 2016/0102378 | A1 | 4/2016 | Omura et al. | |

FOREIGN PATENT DOCUMENTS

| | | | |
|---|---|---|---|
| CN | 104024457 | A | 9/2014 |
| EP | 2602340 | A1 | 6/2013 |
| EP | 2602347 | A1 | 6/2013 |
| EP | 2762578 | A1 | 8/2014 |
| JP | H10298654 | A | 11/1998 |
| JP | 2002012918 | A | 1/2002 |
| JP | 3482340 | B2 | 12/2003 |
| JP | 4091749 | B2 | 5/2008 |
| JP | 4192399 | B2 | 12/2008 |
| JP | 2011246782 | A | 12/2011 |
| JP | 2012031498 | A | 2/2012 |
| JP | 2012036450 | A | 2/2012 |
| JP | 2012052230 | A | 3/2012 |
| JP | 2012172191 | A | 9/2012 |
| JP | 2012177161 | A | 9/2012 |
| JP | 2013072116 | A | 4/2013 |
| JP | 2013087299 | A | 5/2013 |
| JP | 2013234342 | A | 11/2013 |
| JP | 2014019901 | A | 2/2014 |
| KR | 1020140110913 | A | 9/2014 |
| WO | 2013046716 | A1 | 4/2013 |
| WO | 2013099272 | A1 | 7/2013 |
| WO | 2013100200 | A1 | 7/2013 |
| WO | 2014068962 | A1 | 5/2014 |

OTHER PUBLICATIONS

Ichijima, I. et al., "Improvement of Magnetic Properties in Thinner HI-B with Domain-Refinement", IEEE Transactions on Magnetics, Sep. 1984, vol. MAG-20, No. 5, p. 1557.

Jan. 27, 2015, International Search Report issued in the International Patent Application No. PCT/JP2014/005395.

Mar. 14, 2017, Office Action issued by the Japan Patent Office in the corresponding Japanese Patent Application No. 2015-524546 with English language concise statement of relevance.

Mar. 21, 2017, Office Action issued by the Japan Patent Office in the corresponding Japanese Patent Application No. 2016-057529 with English language concise statement of relevance.

Mar. 9, 2018, Office Action issued by the State Intellectual Property Office in the corresponding Chinese Patent Application No. 201480082805.3 with English language Search Report.

Oct. 13, 2017, Extended European Search Report issued by the European Patent Office in the corresponding European Patent Application No. 14904238.4.

Sep. 18, 2018, Office Action issued by the Korean Intellectual Property Office in the corresponding Korean Patent Application No. 10-2017-7012811 with English language Concise Statement of Relevance.

* cited by examiner

GRAIN-ORIENTED ELECTRICAL STEEL SHEET AND PROCESS FOR PRODUCING SAME

TECHNICAL FIELD

This disclosure relates to a grain-oriented electrical steel sheet, and particularly to a grain-oriented electrical steel sheet for a transformer core having a remarkably reduced transformer core loss property. This disclosure also relates to a process for producing the grain-oriented electrical steel sheet.

BACKGROUND

Grain-oriented electrical steel sheets are mainly used for, e.g., iron cores of transformers, and are required to have excellent magnetic properties, in particular, low iron loss.

A variety of processes have been proposed to improve the magnetic properties of grain-oriented electrical steel sheets, including: improving the orientation of crystal grains constituting a steel sheet so that the crystal grains highly accord with the Goss orientation (namely, increasing the frequency of crystal grains with the Goss orientation); applying tension coating to a steel sheet to increase the tension imparted thereto; and applying magnetic domain refinement to a steel surface by introducing strain or forming grooves on its surface.

For example, JP4192399B (PTL 1) describes forming a tension coating having an extremely high tension up to 39.3 MPa to suppress the iron loss of the grain-oriented electrical steel sheet when excited at a maximum magnetic flux density of 1.7 T and a frequency of 50 Hz ($W_{17/50}$) below 0.80 W/kg.

Other conventional techniques for reducing iron loss by introducing strain include plasma flame irradiation, laser irradiation, electron beam irradiation, and the like. For example, JP2011246782A (PTL 2) describes that by irradiating a steel sheet after secondary recrystallization with a plasma arc, the iron loss $W_{17/50}$ can be reduced from 0.80 W/kg at the lowest before the irradiation to 0.65 W/kg or less.

JP201252230A (PTL 3) describes a grain-oriented electrical steel sheet for a transformer low in both iron loss and noise that is obtained by optimizing the thickness of the forsterite film as well as the mean width of magnetic domain discontinuous portions formed on the steel sheet by electron beam irradiation.

JP2012172191A (PTL 4) describes that the iron loss of a grain-oriented electrical steel sheet is reduced by optimizing the output and irradiation time of electron beam.

As described above, improvement of the iron loss of grain-oriented electrical steel sheets is being promoted. However, even if transformers are produced by using, in their iron cores, grain-oriented electrical steel sheets low in iron loss, this does not necessarily lead to a reduction in the iron loss of the resulting transformers (transformer core loss). This is because when evaluating the iron loss of the grain-oriented electrical steel sheet itself, there are excitation magnetic flux components in the rolling direction alone, whereas when the steel sheet is actually used as the iron core of a transformer, excitation magnetic flux components are present not only in the rolling direction but also in the transverse direction (direction orthogonal to the rolling direction).

Building factor (BF) is an index that is commonly used to represent the difference in iron loss between a blank sheet itself and a transformer formed from the blank sheet, and is defined as a ratio of the iron loss of the transformer to the iron loss of the blank sheet. When the BF is 1 or more, this means that the iron loss of the transformer is larger than the iron loss of the blank sheet. Since grain-oriented electrical steel sheets are a material that shows the lowest iron loss when magnetized in the rolling direction, the iron loss of a grain-oriented electrical steel sheet increases if the steel sheet is incorporated in a transformer that is magnetized in directions other than the rolling direction, in which case the BF increases beyond 1. In order to improve the energy efficiency of the transformer, it is necessary not only to lower the iron loss of the blank sheet but also to minimize the BF, i.e., to reduce the BF close to 1.

For example, JP201231498A (PTL 5) describes a technique for improving the BF by optimizing the total tension applied to the steel sheet by the forsterite film and tension coating, even if the coating quality is lowered by laser irradiation or electron beam irradiation.

Further, JP201236450A (PTL 6) describes a technique for achieving a good transformer core loss property by optimizing the interval between dots formed by performing electron beam irradiation in a dot-sequence manner.

*IEEE Trans. magn. Vol. MAG*-20, *No.* 5, p. 1557 (NPL 1) describes that a good BF can be obtained by performing laser irradiation at an inclination with respect to the rolling direction.

On the other hand, focusing on closure domains that are formed at the time of magnetic domain refining using laser irradiation, techniques have also been proposed to reduce iron loss by optimizing the shape and dimensions of closure domains (see JP3482340B [PTL 7] and JP4091749B [PTL 8]).

CITATION LIST

Patent Literature

PTL 1: JP4192399B
PTL 2: JP2011246782A
PTL 3: JP201252230A
PTL 4: JP2012172191A
PTL 5: JP201231498A
PTL 6: JP201236450A
PTL 7: JP3482340B
PTL 8: JP4091749B
PTL 9: JPH10298654A
PTL 10: WO2013046716A

Non-patent Literature

NPL 1: *IEEE Trans. magn. Vol. MAG*-20, *No.* 5, p. 1557

SUMMARY

Technical Problem

However, although the technique described in PTL 5 could improve the BF to some extent when the coating quality is lowered, PTL 5 does not teach a technique that can improve the BF by magnetic domain refining treatment, without damaging the coating by electron beam irradiation.

In the technique of PTL 6, not only is the electron beam processing speed low, but also excessively long irradiation time may damage the coating. Additionally, according to the technique of NPL 1, oblique electron beam irradiation presents the problems of a prolonged scanning length on steel sheets, which makes control more difficult, and a difficulty in reducing the iron loss of a single sheet.

In this respect, since closure domains are oriented in directions different from the rolling direction, it is believed that the BF is possibly improved by other closure domain control techniques as described in PTL 7 and PTL 8. However, PTLs 7 and 8 only consider the iron loss of a single sheet, yet investigation has not been conducted from the viewpoint of transformer core loss.

In addition to the above, the techniques of PTLs 7 and 8 have the problems of the necessity of increasing beam output or beam irradiation time, which may damage the coating formed on the steel sheet surface due to beam irradiation, or lower the processing efficiency.

For example, in the technique of PTL 8, both front and back surfaces of a steel sheet are irradiated with a laser to form closure domains penetrating through the steel sheet in the sheet thickness direction. Therefore, it takes about twice the processing time as compared with usual magnetic domain refining treatment, in which a steel sheet is irradiated with a laser from one side, and the productivity is low.

Further, according to the technique of PTL 7, since the laser has an elliptical spot shape, as explained later, it is believed that damage to the coating is reduced to some extent. However, PTL 7 does not tell whether damage to the coating is suppressed. To verify the fact, we conducted experiments and found that the coating was damaged by closure domains being formed at great depths.

On the other hand, known techniques for reducing damage to the coating without impairing the magnetic domain refining performance include making the laser spot shape elliptical (JPH10298654A [PTL 9]) and increasing the accelerating voltage of electron beam (WO2013046716A [PTL 10]).

However, high irradiation energy is required for forming closure domains deep in the sheet thickness direction, which is necessary for improving the BF, and the conventional techniques have a limited depth to which magnetic domain refining can be performed without damaging the coating.

For example, in the case of using a laser beam, the laser absorptance of the coating in the wavelength range of a laser commonly used for magnetic domain refining is high. Accordingly, even with the use of an elliptical beam spot shape, there are still limitations on the depth in the sheet thickness direction to which magnetic domain refining can be performed without damaging the coating at the irradiated portions.

In the case of using an electron beam, although the beam passes more easily through the coating as the accelerating voltage is increased, if the beam output and the irradiation time are increased to form closure domains to greater depths, the steel substrate experiences greater thermal expansion, stress is introduced to the coating, and the coating is damaged accordingly.

Suppression of coating damage is thus important for steel sheets used as transformer iron cores. When the coating is damaged, recoating over the damaged coating is required to ensure insulation and anti-corrosion properties. This leads to a reduction in the volume fraction (stacking factor) of the steel substrate, which forms the steel sheet together with the coating, thus to a reduction in the magnetic flux density of the steel sheet when used as a transformer iron core, as compared with that in the case of not performing recoating. Alternatively, if the excitation current is further increased to guarantee the magnetic flux density, the iron loss increases.

It could thus be helpful to provide a grain-oriented electrical steel sheet that is very low in transformer core loss and that has a very low BF, in which closure domains are formed without damaging the coating.

It could also be helpful to provide a process for producing the above-described grain-oriented electrical steel sheet having a very low BF.

Solution to Problem

We conducted extensive research to solve the above problems, and as a result discovered that it is possible to form closure domains while suppressing damage to the coating, by performing magnetic domain refining treatment appropriately combining the ellipticity of beam shape and the increase of accelerating voltage of electron beam.

However, the conventional electron beam irradiation techniques have the problem of beam shape greatly varying at the irradiation positions due to the influence of aberration or the like. Although it is possible to make the beam diameter uniform by using dynamic focusing technology or the like, when irradiating a steel sheet with an electron beam while scanning the beam along the width direction, it is extremely difficult to precisely control the beam to assume a desired elliptical shape.

One example of beam shape correction techniques uses stigmators (astigmatism correction devices), which are widely used in electron microscopes and the like. However, conventional stigmators provide such control that correction becomes effective only within a narrow range in the width direction of the steel sheet. Thus, if the beam is deflected as it passes over the entire width of the steel sheet, a sufficient effect cannot be obtained.

We therefore made additional examination, and as a result discovered that an elliptical beam with shape consistency across the entire width of the steel sheet can be formed by dynamically controlling the stigmator according to the beam deflection.

We also investigated the influence of the interval between linear strain regions formed by beam irradiation on the BF, and revealed optimum intervals from the perspective of reducing the iron loss of transformer cores.

Based on the above discoveries, we optimized the interval at which strain is introduced to a steel sheet, the shape and size of closure domains, electron beam irradiation processes and the like, and completed the disclosure.

Specifically, the primary features of this disclosure are as described below.

(1) A grain-oriented electrical steel sheet comprising: a steel sheet; and a tension coating formed on a surface of the steel sheet, wherein the grain-oriented electrical steel sheet has an interlaminar current, as measured by an interlaminar resistance test, of 0.15 A or less, the steel sheet has a plurality of linear strain regions extending in a direction transverse to a rolling direction, the plurality of linear strain regions are formed at line intervals in the rolling direction of 15 mm or less, and each of the plurality of linear strain regions has closure domains formed therein, each of the closure domains having a length d along a sheet thickness direction of 65 μm or more and a length w along the rolling direction of 250 μm or less.

(2) A grain-oriented electrical steel sheet comprising: a steel sheet; and a tension coating formed on a surface of the steel sheet, wherein the grain-oriented electrical steel sheet has an interlaminar current, as measured by an interlaminar resistance test, of 0.15 A or less, the steel sheet has a plurality of linear strain regions extending in a direction transverse to a rolling direction, the plurality of linear strain regions being formed by irradiating the steel sheet with an electron beam, the plurality of linear strain regions are formed at line intervals in the rolling direction of 15 mm or less, and each of the plurality of linear strain regions has closure domains, each of the closure domains having a length d along a sheet thickness direction of 50 μm or more and a length w along the rolling direction of 250 μm or less.

(3) The grain-oriented electrical steel sheet according to (1) or (2), wherein the plurality of linear strain regions are formed at line intervals in the rolling direction of 4 mm or more.

(4) A process for producing a grain-oriented electrical steel sheet, the process comprising: forming a tension coating on a surface of a steel sheet; and continuously irradiating one side of the steel sheet having the tension coating with a focused electron beam in a width direction of the steel sheet, while scanning the focused electron beam along a direction transverse to a rolling direction, wherein as a result of the irradiating with the electron beam, a plurality of linear strain regions extending in a direction orthogonal to the rolling direction are formed at at least a surface portion of the steel sheet, the electron beam has an accelerating voltage of 60 kV or more and 300 kV or less, the electron beam has a beam diameter in a direction orthogonal to the scanning direction of 300 μm or less, and the electron beam has a beam diameter in the scanning direction that is at least 1.2 times the beam diameter in the direction orthogonal to the scanning direction.

(5) The process according to (4), wherein the electron beam has an accelerating voltage of 120 kV or more.

Advantageous Effect

According to the disclosure, the transformer core loss and BF of grain-oriented electrical steel sheets can be remarkably improved without damaging the tension coating. The absence of damage to the tension coating eliminates the need for recoating after beam irradiation. According to the disclosure, there is no need to unduly reduce the line intervals in magnetic domain refining treatment. Therefore, the present disclosure enables production of electrical steel sheets with extremely high efficiency.

DETAILED DESCRIPTION

Figure 1:
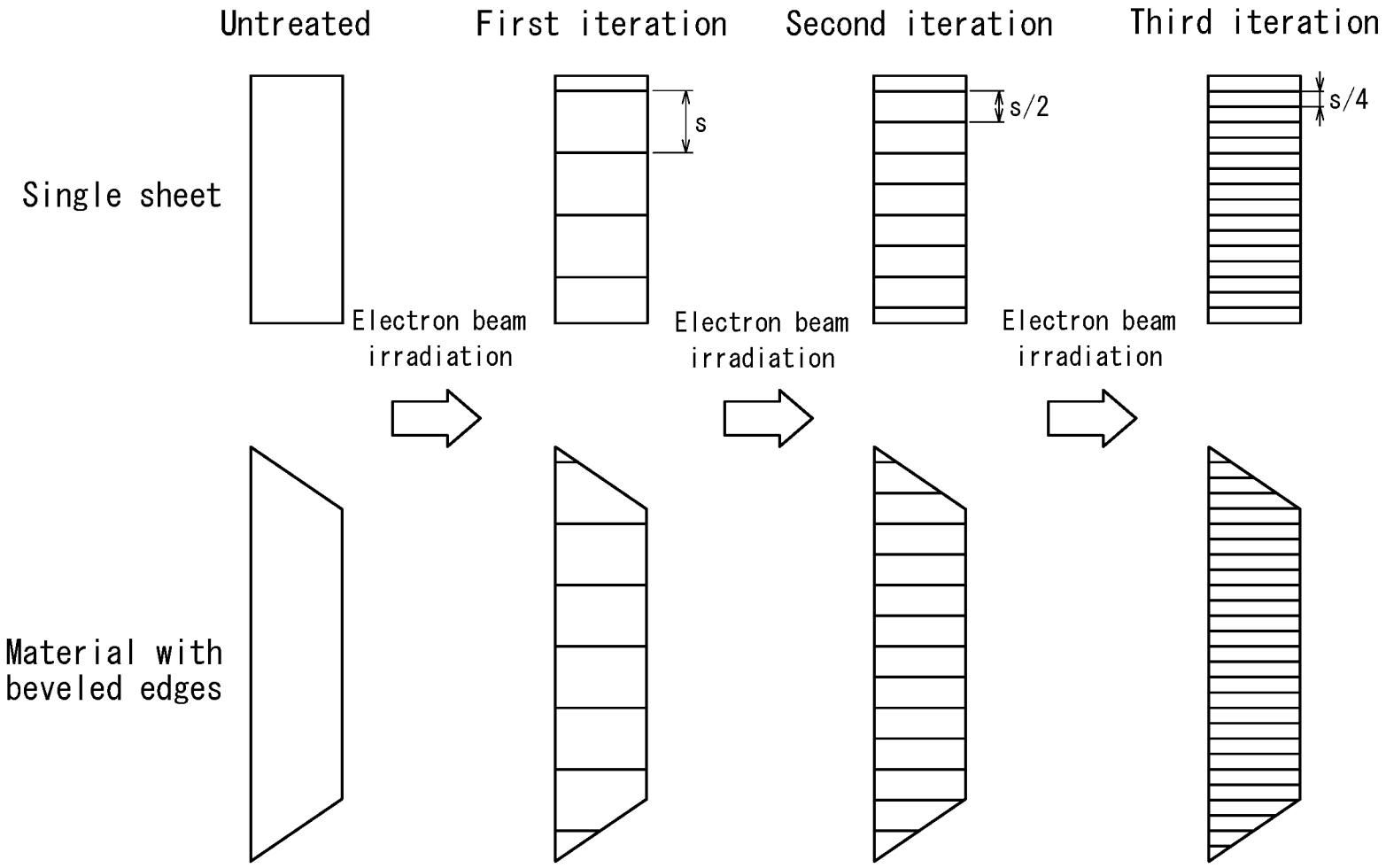
FIG. 1 is a schematic view illustrating how linear strain regions are formed in an experiment for evaluating the influence of irradiation line interval.

The present invention will now be specifically described below.

Grain-Oriented Electrical Steel Sheet

A grain-oriented electrical steel sheet according to the disclosure has a tension coating, and a surface thereof is irradiated with an energy beam to form a plurality of linear strain regions. No particular limitation is placed on the type of grain-oriented electrical steel sheets used as the base material, and various types of known grain-oriented electrical steel sheets may be used.

Tension Coating

A grain-oriented electrical steel sheet used in the disclosure has a tension coating on a surface thereof. No particular limitation is placed on the type of tension coating. As the tension coating, for example, it is possible to use a two-layer coating that is formed by a forsterite film, which is formed in finish annealing and contains $Mg_2SiO_4$ as a main component, and a phosphate-based tension coating formed on the forsterite film. In addition, a phosphate-based tension-applying insulating coating may be directly formed on a surface of the steel sheet not having the forsterite film. The phosphate-based tension-applying insulating coating may be formed, for example, by coating a surface of a steel sheet with an aqueous solution containing a metal phosphate and silica as main components, and baking the coating onto the surface.

According to the disclosure, since the tension coating is not damaged by beam irradiation, it is not necessary to perform recoating for repair after beam irradiation. There is thus no need to unduly increase the thickness of the coating, and it is thus possible to increase the stacking factor of transformer iron cores assembled from the steel sheets. For example, it is possible to achieve a stacking factor as high as 96.5% or more when using steel sheets having a thickness of 0.23 mm or less, and as high as 97.5% or more when using steel sheets having a thickness of 0.24 mm or more.

Interlaminar Current: 0.15 A or Less

As used herein, "interlaminar current" is defined as the total current flowing through a contact as measured with method A, which is one of the measurement methods for interlaminar resistance test specified in JIS-C2550 (methods of test for the determination of surface insulation resistance). The lower the interlaminar current, the better the insulating properties of the steel sheet. In the disclosure, since the tension coating is not damaged by beam irradiation, an interlaminar current as low as 0.15 A or less can be achieved without recoating for repair after beam irradiation. A preferred interlaminar current is 0.05 A or less.

Multiple Linear Strain Regions

In the grain-oriented electrical steel sheet according to the disclosure, a plurality of linear strain regions extending in a direction transverse to the rolling direction are formed. Each strain region has the function of subdividing magnetic domains and reducing iron loss. The plurality of linear strain regions are parallel to each other and are provided at predetermined intervals as described later.

High Energy Beam Irradiation

The plurality of linear strain regions may be formed by irradiating the surface of the steel sheet having the tension coating with a focused high energy beam.

No particular limitation is placed on the type of high energy beam, yet electron beam is preferred because it has such characteristics as suppressing coating damage resulting from increased acceleration voltage, enabling high speed beam control, and the like.

High energy beam irradiation is performed while scanning a beam from one end to the other in the width direction of the steel sheet, using one or more irradiation devices (for example, electron gun(s)). The scanning direction of the beam is preferably inclined at an angle of 60° to 120° with respect to the rolling direction, and more preferably at an angle of 90° that is, it is more preferably perpendicular to the rolling direction. As the deviation from 90° becomes large, the volume of strain-introduced portions may excessively increase, resulting in increased hysteresis loss.

Irradiation Line Interval: 4 mm to 15 mm

The plurality of linear strain regions are formed at constant intervals in the rolling direction, which intervals are referred to herein as "irradiation line intervals" or "line intervals." We conducted the following experiment to determine optimum line intervals for reducing BF and transformer core loss.

Grain-oriented electrical steel sheets were prepared as test pieces. A surface of each test piece was irradiated with an electron beam to form a plurality of linear strain regions. The electron beam irradiation was performed while scanning the electron beam at a constant rate along the width direction of each steel sheet. At this point, formation of linear strain regions was carried out in multiple times as illustrated in FIG. 1. Let s be the irradiation line interval at which strain regions were formed in the first iteration, additional linear strain regions were formed at irradiation line intervals of s/2 in the second iteration and of s/4 in the third iteration. In each stage, linear strain regions were formed at equal intervals. The other conditions were the same as those in the examples described later.

Several reports on the influence of magnetic domain refining treatment conditions on the BF have been made up to now. In those reports, BFs are compared among test pieces by varying beam irradiation conditions. However, BFs are known to be affected by various factors such as the crystal orientation and grain size of the blank sheet. Therefore, in experiments using multiple test pieces as described above, it is impossible to completely eliminate the influence of variation in the characteristics of test pieces, and there is a possibility that the influence of magnetic domain refining treatment conditions on the BF can not be accurately evaluated.

We thus conducted the above experiment to more accurately evaluate the influence of magnetic domain refining treatment conditions on the BF. In our experiment, magnetic domain refining treatment is performed on one test piece so that the irradiation line interval is gradually reduced. Since the same test specimen is used in every stage, just the influence of line intervals can be accurately evaluated without being affected by variations in, for example, Si content, grain diameter, crystal orientation, and the like, which would otherwise affect the results if different steel sheets were used as test pieces in different stages.

Figure 2:
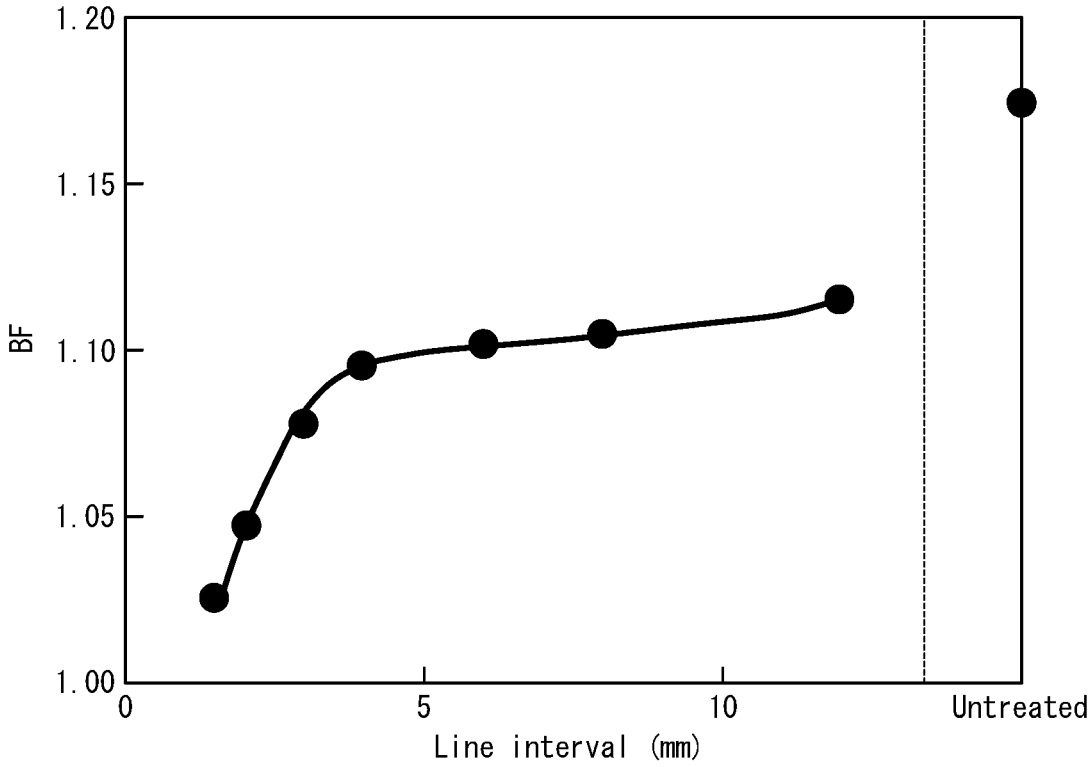
FIG. 2 is a graph illustrating the influence of irradiation line intervals on building factors.

Electron beam irradiation was performed in seven stages, and measurement was made of BFs, transformer core loss, and single-sheet iron loss at the respective stages. Firstly, the irradiation line interval s for the first iteration was set to 12 mm, and a process to form additional strain regions was repeated for the fourth iteration in such a way, as mentioned above, that the line interval was reduced by one-half during each successive iteration. Measurement was made in each iteration. Then, strain relief annealing was performed to remove the strain introduced by the above electron beam irradiation. Further, setting the irradiation line interval s for the first iteration to 8 mm, a strain forming process was repeated for the third iteration, and measurement was made in each iteration. The obtained results are listed in FIGS. 2 and 3. FIG. 2 presents the relationship between the irradiation line intervals and the measured BFs. At any line intervals, the BF was improved as compared with those yielded by test pieces not irradiated with an electron beam (untreated test pieces). It can also be seen that the BF becomes closer to 1 as the line interval becomes smaller.

Figure 3:
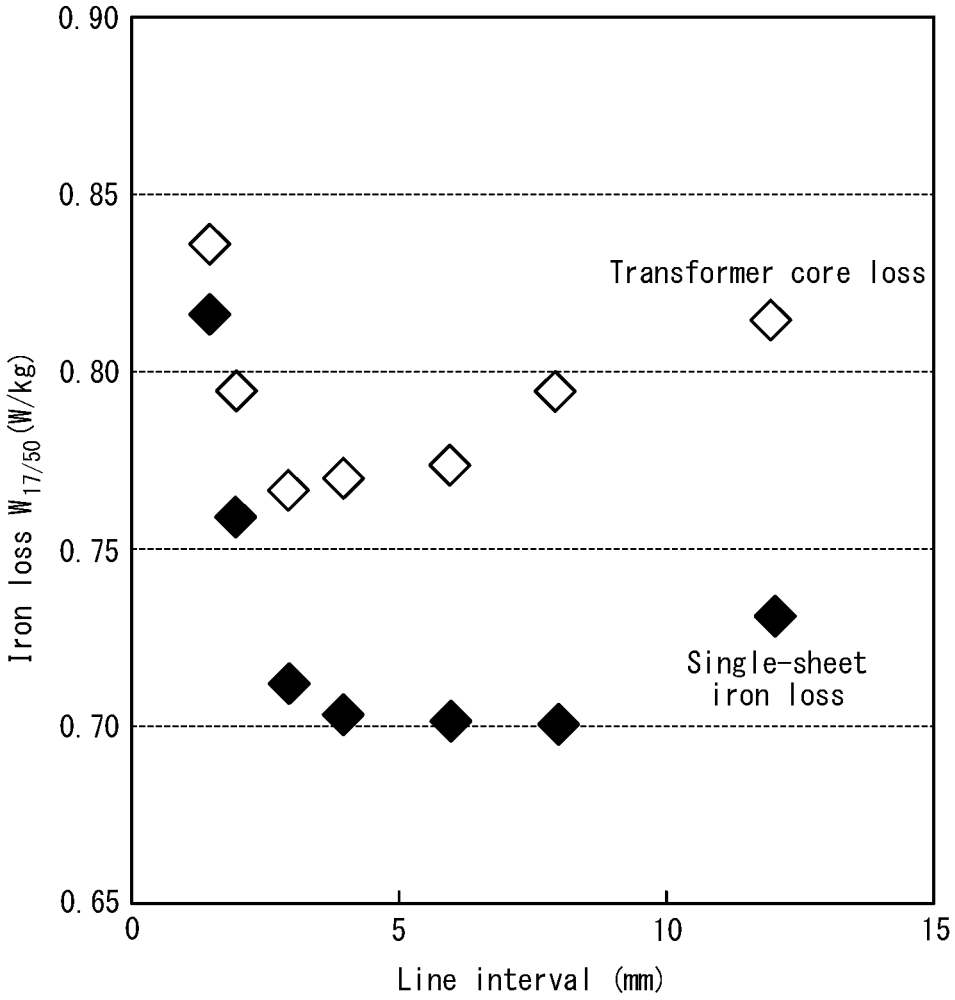
FIG. 3 is a graph showing the effect of irradiation line intervals on transformer core loss and single-sheet iron loss.

FIG. 3 is a graph of measurements of transformer core loss and single-sheet iron loss plotted as a function of irradiation line interval. The single-sheet iron loss was minimized when the line interval was 6 mm to 8 mm, while the transformer core loss was minimized when the line interval was around 3 mm. From this, it can be seen that the transformer core loss and the BF can be sufficiently reduced if the line interval is reduced to about 3 mm.

To reduce the line interval, however, it is necessary to increase the number of linear strain regions to be formed, and as a result, the time required for magnetic domain refining treatment increases. For example, a halving of the line interval requires almost a doubling of the processing time. Such a reduction in production efficiency due to an increase in processing time is unfavorable from an industrial perspective.

Therefore, in the present disclosure, the irradiation line interval is 15 mm or less in consideration of both reduction of BF and transformer core loss and improvement of productivity. If the line interval exceeds 15 mm, the number of crystal grains that are not irradiated with the beam increases, and a sufficient magnetic domain refining effect cannot be obtained. The line interval is preferably 12 mm or less.

On the other hand, the line interval is preferably 4 mm or more according to the disclosure. Setting the line interval to 4 mm or more can shorten the processing time and increase the production efficiency, and can also prevent excessively large strain regions from being formed in the steel, which could lead to increased hysteresis loss and magnetostriction. More preferably, the line interval is 5 mm or more.

Length d Along the Sheet Thickness Direction of Closure Domains: 65 μm or More

In portions irradiated with the electron beam, closure domains different from the main magnetic domains are formed. It is believed that the length d along the sheet thickness direction of closure domains (also referred to as "closure domain depth") affects the iron loss. Therefore, we conducted the following experiment and investigated the relationship between d and transformer core loss.

Electron beam irradiation was performed on steel sheets under different conditions to prepare grain-oriented electrical steel sheets with different d. The value of d was measured by observing a cross section along the sheet thickness direction using a Kerr effect microscope. In all the samples, the length w of closure domains in the rolling direction was set to be approximately the same value of 240 μm to 250 μm.

Figure 4:
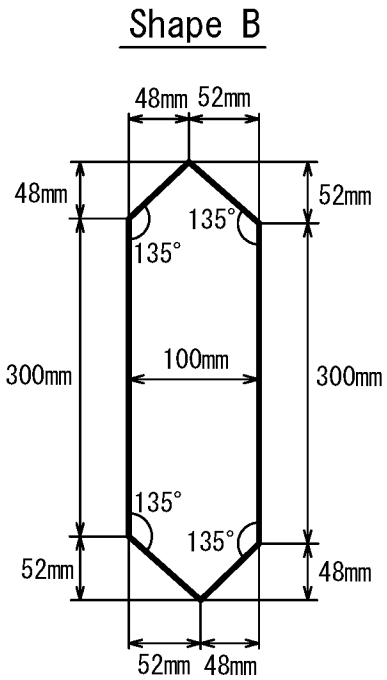
FIG. 4 is a schematic diagram of a core used for measurement of transformer core loss.
Figure 4:
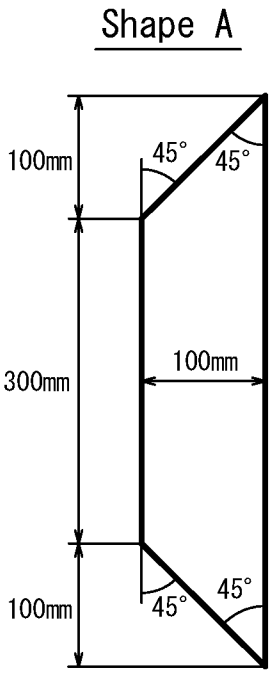
Figure 4:
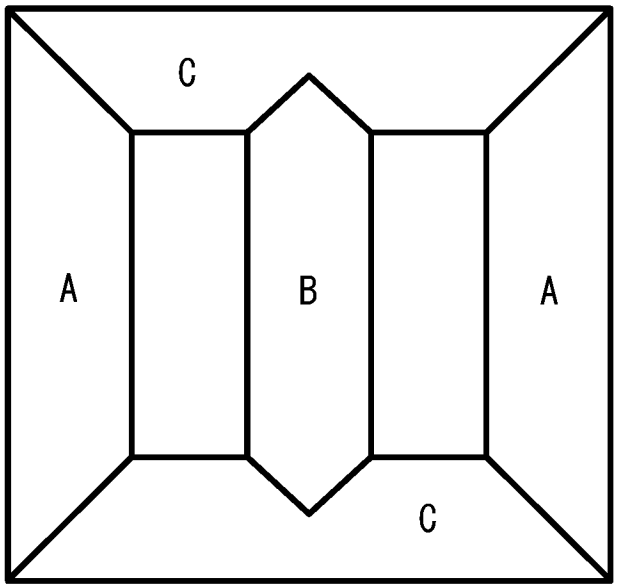
Figure 4:
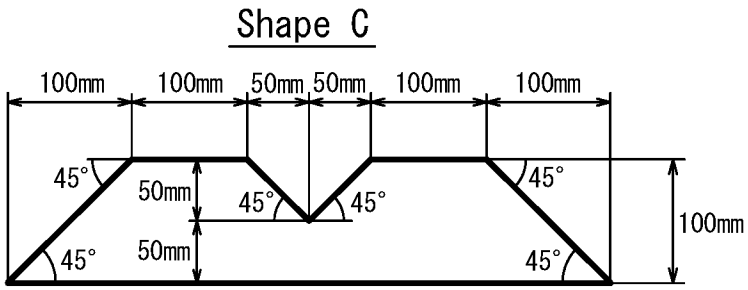

Using the steel sheets thus obtained, transformer iron cores were prepared. Each iron core was of stacked three-phase tripod type, having a 500 mm×500 mm rectangular shape, formed by steel sheets of 100 mm in width as illustrated in FIG. 4. Each iron core was produced by a stack of steel sheets that were sheared to have beveled edges as illustrated in FIG. 4 so that the longitudinal direction coincided with the rolling direction, with a stack thickness of about 15 mm and an iron core weight of about 20 kg. In the lamination procedure, sets of two steel sheets were stacked in five step laps, and arranged in a step-lap joint configuration. The iron core components were stacked flat on a plane, and squeezed between Bakelite retainer plates under a pressure of about 0.1 MPa.

Figure 5:
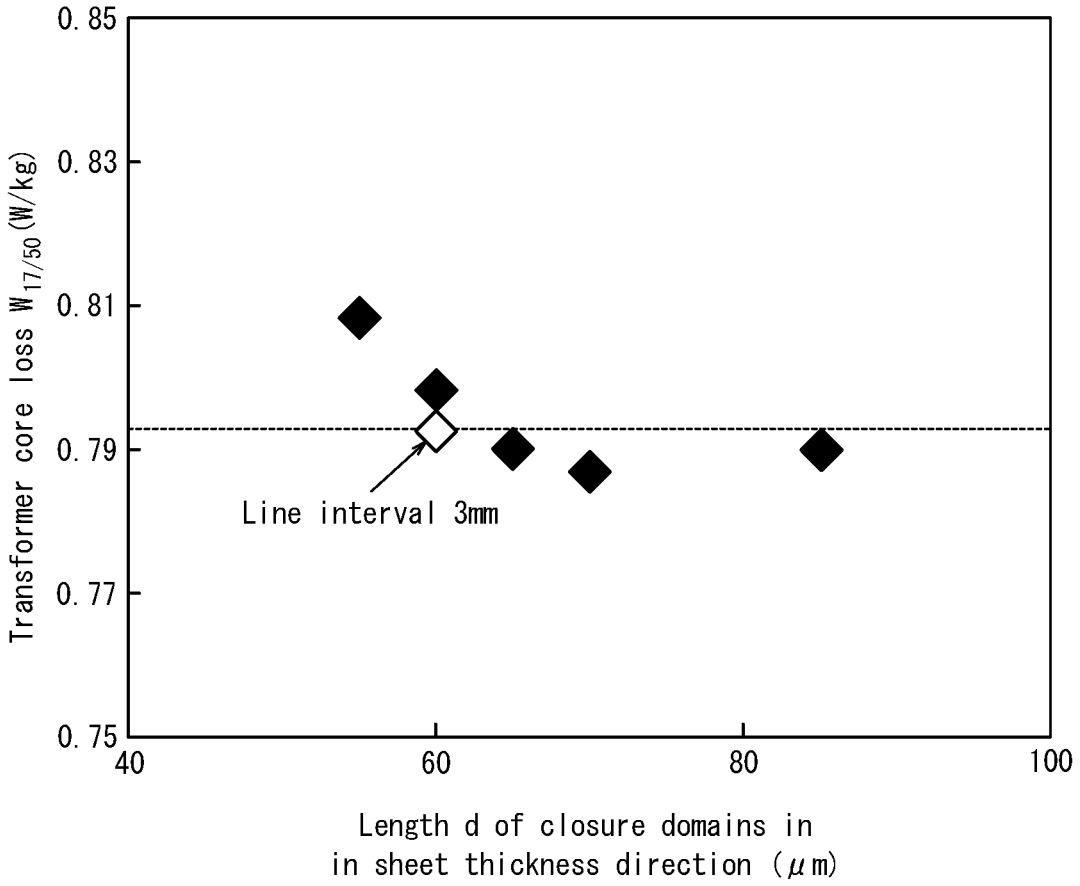
FIG. 5 is a graph illustrating the influence of the length d along the sheet thickness direction of closure domains on transformer core loss.

Then, transformer core loss of each iron core was measured. The excitation conditions in the measurement were a phase difference of 120°, a maximum magnetic flux density of 1.7 T, and a frequency of 50 Hz. The measurement results are shown in FIG. 5. The hollow diamond in the figure represents the result with a line interval of 3 mm, while the other solid diamonds represent the results with a line interval of 5 mm. From these results, it can be seen that the transformer core loss can be reduced by increasing d. In particular, by setting d to 65 μm or more with the line interval of 5 mm, it is possible to obtain transformer core loss properties comparable to those yielded with the line interval of 3 mm. It is thus important for the disclosure to set the length d along the thickness direction of closure domains to 65 μm or more. More preferably, d is 70 μm or more. On the other hand, although no upper limit is placed on the value of d, if d is excessively increased, the coating may be damaged by beam irradiation. Therefore, d is preferably 110 μm or less, and more preferably 90 μm or less.

Length w Along the Rolling Direction of Closure Domains: 250 μm or Less

To improve the BF, it is preferable to increase the volume of closure domains. Increasing the length w of closure domains in the rolling direction (also referred to as "closure domain width") increases the volume of closure domains and reduces the BF, yet may also lead to increased hysteresis loss. Therefore, it is important for the disclosure to set w to 250 μm or less, while increasing the volume of closure domains by increasing d. No lower limit is placed on the value of w, yet w is preferably 160 μm or more, and more preferably 180 μm or more. Here, w is measured from the beam irradiation surface of the steel sheet by magnetic domain observation according to the Bitter method or the like.

The following provides details of the conditions under which magnetic domain refining treatment according to the disclosure is carried out by electron beam irradiation.

Acceleration Voltage Va: 60 kV or More and 300 kV or Less

Higher electron-beam acceleration voltages are more preferable. This is because the higher the acceleration voltage, the higher the material permeability of the electron beam is. A sufficiently high acceleration voltage allows the electron beam to easily transmit through the tension coating, suppressing damage to the coating. Additionally, a higher acceleration voltage shifts the center of heat generation in the steel substrate to a position more distant (deeper) from the steel sheet surface, and thus makes it possible to increase the length d along the sheet thickness direction of closure domains. Moreover, when the acceleration voltage is high, the beam diameter can be reduced more easily. To obtain these effects, the acceleration voltage is 60 kV or more in the present disclosure. The acceleration voltage is preferably 90 kV or more, and more preferably 120 kV or more.

However, if the accelerating voltage is excessively high, it is difficult to provide shielding from x-rays emitted by the steel sheet irradiated with the electron beam. Therefore, from a practical point of view, the acceleration voltage is 300 kV or less. The acceleration voltage is preferably 250 kV or less, and more preferably 200 kV or less.

Beam Diameter

A smaller beam diameter in the direction orthogonal to the beam scanning direction is more advantageous for improving the single-sheet iron loss property. Therefore, the beam diameter in the direction orthogonal to the scanning direction is 300 μm or less in the present disclosure. As used herein, "beam diameter" is defined as the half width of beam profile as measured with a slit method (slit width: 0.03 mm). The beam diameter in the direction orthogonal to the scanning direction is preferably 280 μm or less, and more preferably 260 μm or less.

On the other hand, no lower limit is placed on the beam diameter in the direction orthogonal to the scanning direction, yet a preferred lower limit is 10 μm or more. If the beam diameter in the direction orthogonal to the scanning direction is smaller than 10 μm, the working distance needs to be extremely small, and the range that can be covered by one electron beam source for deflection irradiation is greatly reduced. If the beam diameter in the direction orthogonal to the scanning direction is 10 μm or more, it is possible to irradiate a wide range with one electron beam source. The beam diameter in the direction orthogonal to the scanning direction is preferably 80 μm or more, and more preferably 120 μm or more.

Figure 6:
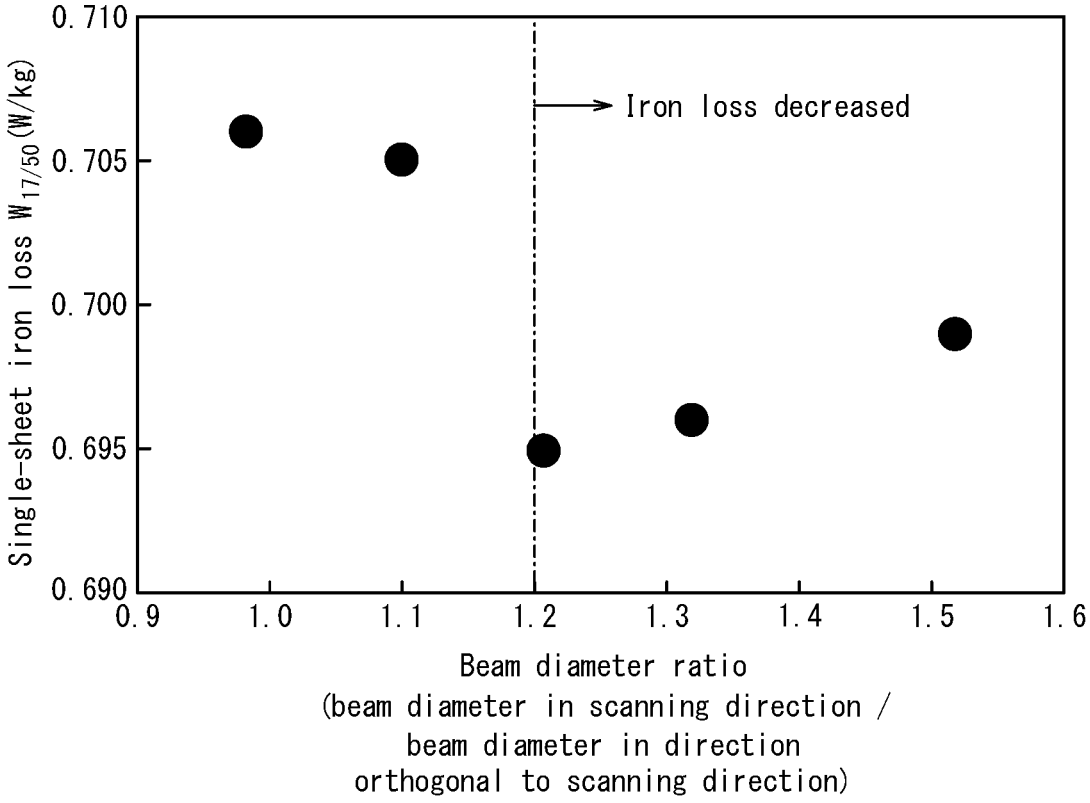
FIG. 6 is a graph illustrating the influence of the ratio of beam diameters in the scanning direction to beam diameters in a direction orthogonal to the scanning direction on single-sheet iron loss.

Furthermore, in the disclosure, the beam diameter in the scanning direction is at least 1.2 times the beam diameter in the direction orthogonal to the scanning direction. Elliptization of the electron beam may be performed using a stigmator. However, due to the stigmator's nature, when the diameter of the beam in one direction is increased, the diameter in the orthogonal direction tends to decrease. Therefore, by increasing the beam diameter in the scanning direction, the length of closure domains in the direction orthogonal to the scanning direction, namely in the rolling direction, can be reduced. Moreover, by increasing the beam diameter in the scanning direction as described above, the time for which a certain point on the steel sheet through which the beam passes is irradiated with the beam is increased by 1.2 times or more. As a result, strain is introduced at greater depths in the sheet thickness direction due to the heat conduction effect. As illustrated in FIG. 6, our experiment demonstrated that the single-sheet iron loss is improved with a beam diameter ratio of 1.2 or more. Therefore, the lower limit of the beam diameter ratio is set to 1.2. In the above experiment, the accelerating voltage was 90 kV and the line interval was 5 mm. The steel sheets had equivalent BFs around 1.15. No upper limit is placed on the beam diameter in the scanning direction. However, as excessively increasing the diameter complicates management of beam irradiation conditions, the beam diameter in the scanning direction is preferably 1200 μm or less, and more preferably 500 μm or less.

Beam Current: 0.5 mA to 30 mA

The beam current is preferably as small as possible from the perspective of beam diameter reduction. If the beam current is excessively large, beam focusing is hampered by Coulomb repulsion between electrons. Therefore, in the disclosure, the beam current is preferably 30 mA or less. More preferably, the beam current is 20 mA or less. On the other hand, when the beam current is excessively small, strain regions necessary for obtaining a sufficient magnetic domain refining effect cannot be formed. Therefore, in the disclosure, the beam current is preferably 0.5 mA or more. More preferably, the beam current is 1 mA or more, and still more preferably 2 mA or more.

Pressure within the Beam Irradiation Region

Electron beam is increased in diameter when scattered by gas molecules. To suppress the scattering, the pressure within the beam irradiation region is preferably set to 3 Pa or less. Although no lower limit is placed on the pressure, excessively lowering the pressure results in a rise in the cost of the vacuum system such as a vacuum pump. Therefore, in practice, the pressure is preferably $10^{-5}$ Pa or more.

WD (Working Distance): 1000 mm or Less

The distance between a coil used for focusing the electron beam and a surface of a steel sheet is called "working distance (WD)." The WD is known to have a significant influence on the beam diameter. When the WD is reduced, the beam path is shortened and the beam converges more easily. Therefore, in the disclosure, the WD is preferably 1000 mm or less. Further, in the case of using a beam with a small diameter of 100 μm or less, the WD is preferably 500 mm or less. On the other hand, no lower limit is placed on the WD, yet a preferred lower limit is 300 mm or more, and more preferably 400 mm or more.

Scanning Rate

The scanning rate of the beam is preferably 30 m/s or higher. As used herein, "scanning rate" refers to the mean scanning rate during the irradiation of a beam while scanning the beam from one end to the other along the width direction of a steel sheet. If the scanning rate is lower than 30 m/s, the processing time is prolonged and the productivity is lowered. The scanning rate is more preferably 60 m/s or higher.

Quadrupole and octupole stigmators are predominantly used, and may also be used in the disclosure. Since the correction of the elliptical shape of the beam depends on the amount of current flowing through the stigmator, it is important to change the amount of current flowing through the stigmator while scanning the beam over the steel sheet, so that the beam shape remains uniform all the time in the width direction of the steel sheet.

EXAMPLES

Our products and methods will be described in detail below. The following examples are preferred examples of the disclosure, and the disclosure is not limited at all by the disclosed examples. It is also possible to carry out the disclosure by making modifications without departing from the scope and sprit of the disclosure, and such modes are also encompassed by the technical scope of the disclosure.

Cold rolled steel sheets were subjected to primary recrystallization annealing. Then, an annealing separator containing MgO as a main component was applied to a surface of each steel sheet. Each steel sheet was then subjected to final annealing to prepare a grain-oriented electrical steel sheet having a forsterite film. Subsequently, a composition for forming tension coating that contained colloidal silica and magnesium phosphate was applied and baked onto the surface of the forsterite film to form a phosphate-based tension coating. The thickness of each obtained grain-oriented electrical steel sheet was 0.23 mm.

The surface of each grain-oriented electrical steel sheet was irradiated with an electron beam to form a plurality of linear strain regions extending in a direction transverse to the rolling direction. The mean scanning rate of the electron beam was set to 90 m/s, and the pressure in the processing chamber used for the irradiation of the electron beam was set to 0.1 Pa. The angle of the linear strain regions with respect to the rolling direction (line angle) was set to 90°. Other processing conditions are as listed in Table 1.

Next, measurement was made of the dimensions of closure domains, interlaminar current, BFs, single-sheet iron loss, and transformer core loss of the grain-oriented electrical steel sheets formed by the above-described electron beam irradiation. The measurement method is as follows.

Dimensions of Closure Domains

The length d along the sheet thickness direction of closure domains was measured by observing a cross section along the sheet thickness direction using a Kerr effect microscope. The length w of closure domains in the rolling direction was measured by placing a magnet viewer containing a magnetic colloid solution on the surface of the steel sheet irradiated with the electron beam, and observing the magnetic domain pattern transferred to the magnet viewer.

Interlaminar Current

The interlaminar current was measured in conformity with method A, which is one of the measurement methods for interlaminar resistance test specified in JIS-C2550. In measuring the interlaminar resistance, the total current flowing through the contact was used as the interlaminar current.

Single-Sheet Iron Loss, Transformer Core Loss, and BFs

Single-sheet iron loss, transformer core loss, and BFs were measured according the aforementioned method. The iron cores used for the measurement of transformer core loss are as illustrated in FIG. 4.

The measurement results are as listed in Table 1. In any of our examples which satisfy the conditions of the disclosure, the iron loss, BFs, and interlaminar current were sufficiently reduced, and our examples all exhibited suitable characteristics for transformer iron cores. In contrast, in the comparative examples which do not satisfy the conditions of the disclosure, either the transformer core loss or the interlaminar current was higher than that of our examples, and the comparative examples all showed inferior characteristics.

TABLE 1

| | Electron beam irradiation conditions | | | | | | |
|---|---|---|---|---|---|---|---|
| No. | Acceleration voltage (kV) | Beam current (mA) | WD (mm) | Beam diameter in orthogonal direction*1 (μm) | Beam diameter in scanning direction (μm) | Beam diameter ratio*2 | Line interval (mm) |
| 1 | 150 | 11 | 800 | 170 | 220 | 1.29 | 5 |
| 2 | 90 | 18 | 750 | 210 | 200 | 0.95 | 5 |
| 3 | 90 | 19 | 750 | 210 | 300 | 1.43 | 5 |
| 4 | 150 | 7 | 800 | 170 | 220 | 1.29 | 5 |
| 5 | 180 | 8 | 800 | 140 | 180 | 1.29 | 5 |
| 6 | 150 | 10 | 800 | 160 | 220 | 1.38 | 5 |
| 7 | 180 | 6.5 | 400 | 120 | 150 | 1.25 | 5 |
| 8 | 150 | 16 | 800 | 270 | 360 | 1.33 | 5 |
| 9 | 150 | 11 | 800 | 170 | 230 | 1.35 | 16 |
| 10 | 120 | 17 | 750 | 210 | 300 | 1.43 | 4 |
| 11 | 60 | 28 | 450 | 220 | 220 | 1.00 | 4 |
| 12 | 60 | 28 | 450 | 220 | 380 | 1.73 | 4 |

TABLE 1-continued

| | Closure domains | | Measurement results | | | | |
|---|---|---|---|---|---|---|---|
| No. | Length in sheet thickness direction: d (μm) | Length in rolling direction: w (μm) | BF | Single-sheet iron loss $W_{17/50}$ (W/kg) | Transformer core loss $W_{17/50}$ (W/kg) | Interlaminar current (A) | Remarks |
| 1 | 74 | 195 | 1.162 | 0.673 | 0.782 | 0.03 | Example |
| 2 | 65 | 250 | 1.156 | 0.696 | 0.805 | 0.20 | Comparative Example |
| 3 | 65 | 235 | 1.154 | 0.696 | 0.803 | 0.03 | Example |
| 4 | 64 | 170 | 1.194 | 0.679 | 0.811 | 0.03 | Comparative Example |
| 5 | 85 | 215 | 1.157 | 0.685 | 0.793 | 0.03 | Example |
| 6 | 75 | 200 | 1.167 | 0.680 | 0.794 | 0.05 | Example |
| 7 | 80 | 205 | 1.155 | 0.678 | 0.783 | 0.03 | Example |
| 8 | 70 | 275 | 1.155 | 0.702 | 0.811 | 0.04 | Comparative Example |
| 9 | 74 | 195 | 1.178 | 0.695 | 0.819 | 0.03 | Comparative Example |
| 10 | 76 | 240 | 1.145 | 0.699 | 0.800 | 0.03 | Example |
| 11 | 70 | 250 | 1.149 | 0.699 | 0.803 | 0.22 | Comparative Example |
| 12 | 65 | 245 | 1.152 | 0.700 | 0.806 | 0.03 | Example |

*[1]beam diameter in the direction orthogonal to the scanning direction

*[2]beam diameter in the scanning direction/beam diameter in the direction orthogonal to the scanning direction For example, in Comparative Example No. 2 where the ratio of the beam diameter in the scanning direction to the beam diameter in the direction orthogonal to the scanning direction was less than 1.2, the amount of beam current necessary for sufficiently reducing the iron loss in the single sheet excessively increased, and the damage to the tension coating was not sufficiently suppressed, resulting in increased interlaminar current. On the other hand, in Example No. 3 which was treated under substantially the same conditions except for the beam current and the beam diameter ratio, the interlaminar current was sufficiently low and good insulation characteristics were obtained for equivalent iron loss.

Although Comparative Example No. 4, whose length d along the thickness direction of closure domains was smaller than that specified by the disclosure, exhibited single-sheet iron loss equivalent to that of Example No. 1, the transformer core loss could not be sufficiently lowered and the BF was high accordingly.

In Example No. 7, the beam diameter was made very small by reducing the WD. In this example, the length d along the sheet thickness direction of closure domains was large, and the length w of closure domains in the rolling direction was suppressed to be relatively small. In Comparative Example No. 8, although the acceleration voltage was as high as 150 kV, the focusing condition was changed to slightly increase the beam diameter. This comparative example had an excessively large w and was inferior in single-sheet iron loss and transformer core loss. In Comparative Example No. 9 where the line interval was increased to as large as 16 mm, the BF was high and the single-sheet iron loss was relatively high as compared with Example No. 1.

The invention claimed is:

1. A grain-oriented electrical steel sheet comprising:

a steel sheet; and a tension coating formed on a surface of the steel sheet, wherein the grain-oriented electrical steel sheet has an interlaminar current, as measured by an interlaminar resistance test, of 0.15 A or less, the steel sheet has a plurality of linear strain regions extending in a direction transverse to a rolling direction, the plurality of linear strain regions are formed at line intervals in the rolling direction of 15 mm or less, and each of the plurality of linear strain regions has closure domains formed therein, each of the closure domains having a length d along a sheet thickness direction of 65 μm or more and a length w along the rolling direction of 250 μm or less.

2. The grain-oriented electrical steel sheet according to claim 1, wherein the plurality of linear strain regions are formed at line intervals in the rolling direction of 4 mm or more.

3. The grain-oriented electrical steel sheet according to claim 1, wherein the length d is 70 μm or more and 110 μm or less, and the length w is 245 μm or less.

4. The grain-oriented electrical steel sheet according to claim 1, wherein the tension coating is not recoated.

5. A grain-oriented electrical steel sheet comprising:

a steel sheet; and a tension coating formed on a surface of the steel sheet, wherein the grain-oriented electrical steel sheet has an interlaminar current, as measured by an interlaminar resistance test, of 0.15 A or less, the steel sheet has a plurality of linear strain regions extending in a direction transverse to a rolling direction, the plurality of linear strain regions being formed by irradiating the steel sheet with an electron beam, the plurality of linear strain regions are formed at line intervals in the rolling direction of 15 mm or less, and each of the plurality of linear strain regions has closure domains, each of the closure domains having a length d along a sheet thickness direction of 65 μm or more and a length w along the rolling direction of 250 μm or less.

6. The grain-oriented electrical steel sheet according to claim 5, wherein the plurality of linear strain regions are formed at line intervals in the rolling direction of 4 mm or more.

7. The grain-oriented electrical steel sheet according to claim 5, wherein the tension coating is not recoated.

8. A process for producing a grain-oriented electrical steel sheet according to claim 5, the process comprising:

forming a tension coating on a surface of a steel sheet; and continuously irradiating one side of the steel sheet having the tension coating with a focused electron beam in a width direction of the steel sheet, while scanning the focused electron beam along a direction transverse to a rolling direction, wherein as a result of the irradiating with the electron beam, a plurality of linear strain regions extending in a direction orthogonal to the rolling direction are formed at at least a surface portion of the steel sheet, the electron beam has an accelerating voltage of 90 kV or more and 300 kV or less, the electron beam has a beam current of 6.5 mA or more, the electron beam has a beam diameter in a direction orthogonal to the scanning direction of 300 μm or less, and the electron beam has a beam diameter in the scanning direction that is at least 1.2 times the beam diameter in the direction orthogonal to the scanning direction.

9. The process according to claim 8, wherein the electron beam has an accelerating voltage of 120 kV or more.

* * * * *